US006732487B2

(12) United States Patent
Bouraoui et al.

(10) Patent No.: US 6,732,487 B2
(45) Date of Patent: May 11, 2004

(54) POST PROCESSING CLOSURE CAP APPLICATION

(75) Inventors: Hichem Bouraoui, Arlington Heights, IL (US); Dave Anchor, Union, IL (US); Peter Agren, Buffalo Grove, IL (US)

(73) Assignee: Tetra Laval Holdings & Finance, S.A., Pully (CH)

( * ) Notice: Subject to any disclaimer, the term of this patent is extended or adjusted under 35 U.S.C. 154(b) by 0 days.

(21) Appl. No.: 09/989,596

(22) Filed: Nov. 20, 2001

(65) Prior Publication Data

US 2003/0093972 A1 May 22, 2003

(51) Int. Cl.[7] ..... B67B 1/06
(52) U.S. Cl. ..... 53/331.5; 53/317; 53/75
(58) Field of Search ..... 53/313, 315, 317, 53/331.5, 75

(56) References Cited

U.S. PATENT DOCUMENTS

| | | | | | |
|---|---|---|---|---|---|
| 1,664,514 | A | * | 4/1928 | Kramer | 53/314 |
| 2,072,245 | A | * | 3/1937 | Cuthbert et al. | 53/314 |
| 2,734,672 | A | * | 2/1956 | Day et al. | 53/318 |
| 2,855,736 | A | * | 10/1958 | Harmone et al. | 53/490 |
| 2,942,394 | A | * | 6/1960 | Bjering et al. | 53/314 |
| 3,179,237 | A | * | 4/1965 | Ninneman | 53/313 |
| 3,280,534 | A | * | 10/1966 | Hildebrandt | 53/315 |
| 3,623,292 | A | * | 11/1971 | Barnes | 53/331.5 |
| 3,905,177 | A | * | 9/1975 | Herzog | 53/314 |
| 3,908,341 | A | * | 9/1975 | Conti | 53/314 |
| 3,977,161 | A | * | 8/1976 | Faber et al. | 53/313 |
| 4,147,249 | A | * | 4/1979 | Tourres | 198/459.1 |
| 5,058,360 | A | | 10/1991 | Yamazaki et al. | |
| 5,272,855 | A | | 12/1993 | Togi et al. | |
| 5,321,935 | A | * | 6/1994 | Spatz et al. | 53/490 |
| 5,435,803 | A | | 7/1995 | Owen et al. | |
| 5,484,374 | A | | 1/1996 | Bachner et al. | |
| 5,601,669 | A | | 2/1997 | Moody et al. | |
| 5,653,832 | A | | 8/1997 | Thompson et al. | |
| 5,819,504 | A | | 10/1998 | Giacomelli et al. | |
| 5,927,594 | A | | 7/1999 | Gianpaolo | |

FOREIGN PATENT DOCUMENTS

| | | | | |
|---|---|---|---|---|
| GB | 2117744 | * | 10/1983 | B67B/3/20 |

* cited by examiner

*Primary Examiner*—John Sipos
*Assistant Examiner*—Louis Tran
(74) *Attorney, Agent, or Firm*—Welsh & Katz, Ltd.

(57) ABSTRACT

A post processing cap applicator for applying a cap to a closure spout after erection, spout attachment, filling and sealing of a carton accommodates custom caps. Cartons are conveyed through the applicator in a first forward direction. A cap supply is configured to dispense caps and to position an edge of a cap in a path defined by movement of the closure spout through the applicator. The closure spout engages the edge of the cap. The applicator includes a rotating, torque-applying element and a drive operably connected to the torque-applying element. The drive is operable in a first direction to tighten the cap onto the spout to a predetermined torque and, once the predetermined torque is reached, to stop tightening the cap. A method for post processing cap application is also disclosed.

16 Claims, 3 Drawing Sheets

POST PROCESSING CLOSURE CAP APPLICATION

BACKGROUND OF THE INVENTION

This invention relates to closure cap application subsequent to forming, filling and sealing a package. More particularly, the invention relates to a method for applying a cap to a closure after processing of a package on which the closure is affixed.

Gable top cartons have become widely used and accepted. One form of the gable top carton includes a carton having a plastic or like spout affixed to the carton for dispensing product. For example, one widely recognized use is for packaged juices. In such an arrangement, a plastic spout is affixed to the carton. A cap is threaded on to the spout for resealing the carton after initial use.

In one typical arrangement, the spout includes a membrane that extends across the inner portion thereof. The membrane provides a seal both for hygienic purposes, as well as tamper evidence. In a typical form, fill and seal operation, carton blanks are fed along a conveyance path on which the cartons are erected (i.e., formed and sealed), sterilized, filled and sealed. After erection, and prior to filling, a closure is affixed to the carton at one of the slanted gable panels.

In known form, fill and seal operations, the spout or closure and its cap are affixed to the carton as a unitary assembly. That is, the spout having the cap threaded thereon is inserted into an interior portion of the carton and is moved into contact so that a flange of the closure rests against an inner surface of the carton. To do this, the spout and cap are inserted through an opening in the gable panel wall of the carton. An ultrasonic welding horn is brought into contact with the carton to weld the closure flange to the carton interior. Subsequently, the carton is sterilized, filled and top sealed. An exemplary arrangement for mounting or affixing the fitments is disclosed in Sweeney, U.S. Pat. No. 6,145,275, which patent is incorporated herein by reference.

It has been found that in certain instances, it is desirable to use non-standard closure caps on the containers. For example, it may be that certain caps are easier for an individual having limited mobility of their fingers to remove from the package. It may also be that certain packagers or bottlers wish to have other than a "standard" threaded cap on a particular package. These include over-sized or not fully round caps. Other functional, as well as aesthetic reasons may be present for "custom" capping.

Known spout or fitment applicators simply cannot accommodate custom capping. A variety of arrangements are known for supporting and moving fitments (generally referring to the spout and cap "package") into engagement with the container. However, these known arrangements require that the spout or fitment, have the cap attached thereto, prior to insertion through the opening in the side wall or gable panel of the carton. These arrangements may not, because of their limitations, provide this "custom" capping ability. More specifically, many such "custom" caps will not fit through standard pre-punched carton panel openings.

Accordingly, there exists a need for an arrangement by which custom caps can be applied to containers. Such custom caps may be oversized and thus, cannot be inserted through an opening in the gable panel of the carton. Desirably, such a custom capping arrangement permits the use of these oversized closures as well as non-symmetrical or creatively designed cap configurations. Most desirably, the custom caps can be applied to cartons processed or packaged on conventional form, fill and seal packaging machines using conventional or standard pre-punched carton blanks.

BRIEF SUMMARY OF THE INVENTION

A post processing cap applicator applies a cap to a closure spout after erection, spout attachment, filling and sealing of a carton. The applicator permits the use of custom caps on standard and non-standard cartons having standard and non-standard, attached spouts.

The applicator includes a cap supply, means for maintaining engagement of the cap with the spout, means for rotating the cap to a predetermined torque, means for determining when the predetermined torque is achieved and means for halting rotation of the cap upon sensing the predetermined torque.

The applicator can include chute means for conveying caps to the cartons. The means for maintaining engagement of the cap with the spout can be biased and the means for rotating the cap can be reversible.

In one embodiment, the applicator includes a conveyor for moving the cartons through the applicator. The conveyor moves in a first forward direction. The cap supply is configured to dispense caps and to position an edge of a cap in a path defined by movement of the closure spout through the applicator. The closure spout engages the edge of the cap.

The torque-applying element is a rotating member such as a rotating belt. In one embodiment, the belt is a reversible member. A drive is operably connected to the torque-applying element and is operable in a first direction to tighten the cap onto the spout to a predetermined torque. Once the predetermined torque is reached, the element stops tightening the cap.

The drive can be configured to reverse direction of the torque-applying element upon sensing that the predetermined torque has been reached. In one embodiment, the conveyor is configured to move the cartons through the applicator at a predetermined rate. Upon reversing direction of the torque-applying element, the drive operates to match a rotational speed of the torque-applying element to a predetermined rate of the cartons moving through the conveyor. A preferred drive is a servomotor.

In an alternate embodiment, the belt rotates in one direction. During a cap tightening phase, the belt moves at a first speed that is less than the speed of the conveyor. Upon reaching a predetermined torque, the belt speed increases to match the line speed (i.e., corresponding to the rate at which the cartons move through the conveyor).

The cap supply can include a chute for delivering caps to respective cartons. The chute is disposed to position the cap edge in the closure spout path. A retention assembly is disposed at about an end of the chute to retain the cap at the end of the chute for engagement by the spout. The retention assembly can include a biased retention element.

The applicator can include a pressure plate cooperating with the torque-applying element to urge the cap onto the spout. Preferably, the torque-applying element is a reversibly rotating belt.

The applicator can further include a lateral movement inhibiting member disposed on a side of the cap opposite the torque-applying element. The inhibiting member can be formed as a surface positioned on an opposite side of the cap that is contacted by the torque-applying element. The surface can be smooth. Alternately, the surface can be frictional or can be formed to accommodate odd-shaped caps. The lateral movement inhibiting surface can be formed coextensive with the pressure plate.

The conveyor can include first and second rotating conveying belts for engaging first and second sides of the carton, respectively. Preferably, the torque-applying element is a reversibly rotating capping belt disposed on the first side of the carton above the first conveying belt.

The capping belt is configured to rotate in a direction opposite of the first conveying belt when tightening the cap onto the spout and configured to reverse direction upon reaching the predetermined torque. When in the reverse direction, the capping belt speed is matched to the conveyor speed so as to not loosen the cap.

A method for applying a cap to a carton in a post-processing closure cap applicator in which the carton is erected, has a spout attached thereto, is filled and sealed, includes the steps of conveying the carton through the cap applicator at a predetermined speed, engaging a cap with the spout, rotating the cap to a predetermined torque, sensing when the predetermined torque is reached and ceasing rotation of the cap.

The step of rotating the cap can include the step of contacting the cap with a torque-applying element and can include the step of rotating the torque-applying element to apply a torque to the cap The method can also include the step ceasing torque-applying rotation of the torque-applying element upon reaching the predetermined torque and reversing the torque-applying element upon reaching the predetermined torque.

A preferred method includes the step of conveying the cap to the spout and maintaining a pressure on the cap as it is engaged with the spout.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
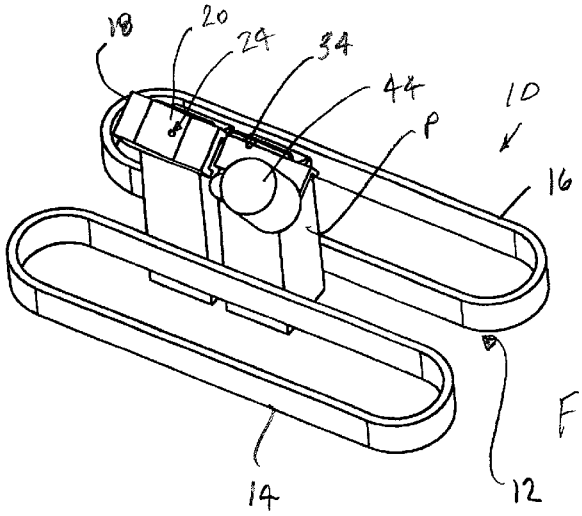
FIG. 1 is a perspective illustration of an embodiment of a post processing cap applicator in accordance with the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown an arrangement for post processing closure cap application. The post processing closure cap applicator 10 is configured for use in conjunction with a form, fill and seal packaging machine such as that disclosed in Giacomelli et al., U.S. Pat. No. 5,819,504, commonly assigned herewith and incorporated herein by reference.

In a conventional, form and seal packaging machine, subsequent to forming and sealing the bottom of the carton, the carton advances to a station at which a spout is affixed to the carton. An applicator such as that disclosed and described in the aforementioned U.S. Pat. No. 6,145,275 to Sweeney can be used. At such a station, a spout is carried by an anvil or a mandrel into an interior portion of the carton. The anvil is advanced so that the spout flange is moved into engagement with an interior surface of the carton.

An ultrasonic welding horn is brought into contact with the carton exterior surface and the flange is sealed to the carton interior surface by application of ultrasonic energy. Other arrangements for moving the closures into the carton and sealing or welding the closures to the carton will be recognized by those skilled in the art.

As will also be recognized by those skilled in the art, the spout or fitment has a cap fitted thereon. Typically, caps are threaded onto the spouts. To this end, the cap (which is the widest portion of the fitment other than the spout flange) must be sized, relative to the opening in the carton, so that the cap readily fits through the panel opening and within the ultrasonic sealing horn. As such, the closure caps must be of a relatively standard size and configuration or shape.

It has been found that it is often desirable to use different sizes and configurations of caps. That is, it has been found that it is desirable to use caps other than the standard closure cap. Many of these custom caps are larger than typical caps. They can also be out-of-round or have scalloped or otherwise non-circular shapes. In addition, many such caps have a diameter that is larger than the conventional opening in the carton gable panel through which the spout is positioned for sealing.

As will be recognized by those skilled in the art, the opening size is dictated by certain limitations. For example, there must be sufficient area for the closure flange to be sealed or welded to the carton panel. As such, the size of the opening is limiting vis-à-vis the size of conventional closure packages (and consequently closure caps).

In an arrangement in accordance with the present invention, the spout portion of the closure is affixed to the carton in accordance with the operation of a conventional form, fill and seal packaging machine. The spout can be mounted on a mandrel or anvil and inserted into the interior portion of the carton. An ultrasonic welding horn engages the carton, over the spout, and the flange portion of the spout is sealed to the carton interior surface. Subsequently, the carton is sterilized and filled. Subsequent to filling, the top panels of the carton are folded and sealed to one another to form the sealed package. Alternately, of course, the spout can be post-applied to the carton with the flange, for example, adhered to an outside surface of the carton gable panel.

After the package is sealed (e.g., top fin F sealed), it can undergo a subsequent sterilization in accordance with known methods. A cap is then affixed to the spout in a post-processing application.

Figure 2:
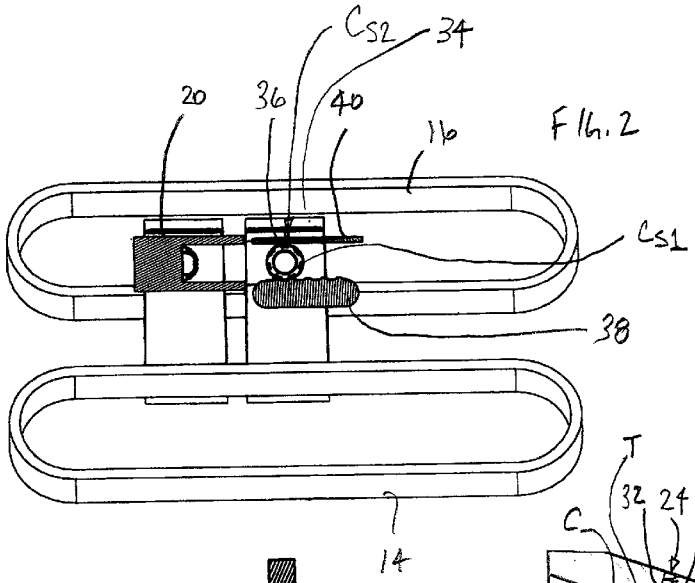
FIG. 2 is another perspective illustration shown with portions of the applicator in cross-section for ease of viewing.

Referring now to FIGS. 1 and 2, generally, there is shown at 10 one embodiment of an apparatus for post-processing cap C application. The apparatus 10 can be installed at about the end of the conventional, form, fill and seal packaging machine. Alternately, the apparatus 10 can be a separate, stand-alone unit for post application of caps C.

In the illustrated embodiment, the apparatus 10 includes a conveyor 12 for moving the packages, containers or cartons P through the applicator section. The illustrated conveyor 12 includes a pair of moving belts 14, 16 that grip the container P on opposing sides $W_1$, $W_1$ and move the container P through the applicator 10. As shown, the belts 14, 16 grip the container P on a side $W_1$ on which the cap C is to be applied, and an opposing side $W_2$.

As will be recognized by those skilled in the art, the conveyor 12 is configured to move at one or more predetermined speeds so as to move the cartons P therethrough at an indexed, predetermined rate.

Figure 3:
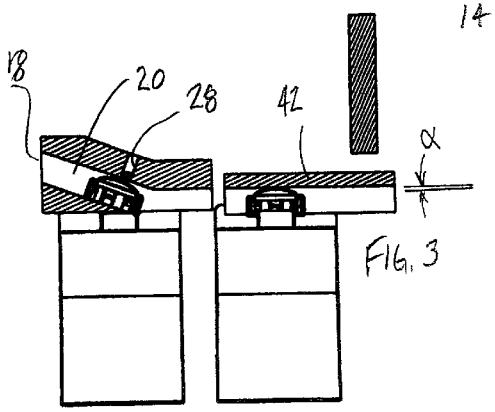
FIG. 3 is a partial cross-sectional schematic illustration showing two cartons as they are conveyed through the applicator, a first carton being at the cap chute exit and a second carton being at the torque-applying station.
Figure 4:
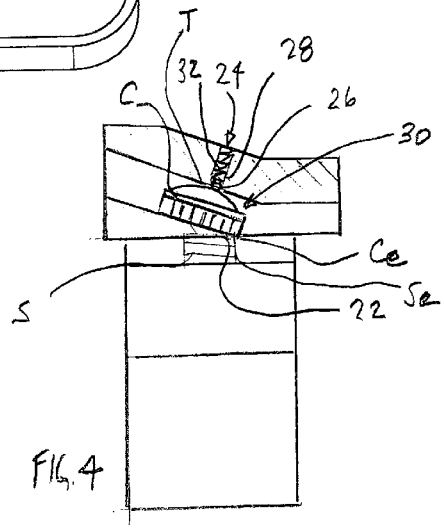
FIG. 4 is an enlarged view of the cap chute exit showing the carton spout "pulling" the cap from the chute.
Figure 5:
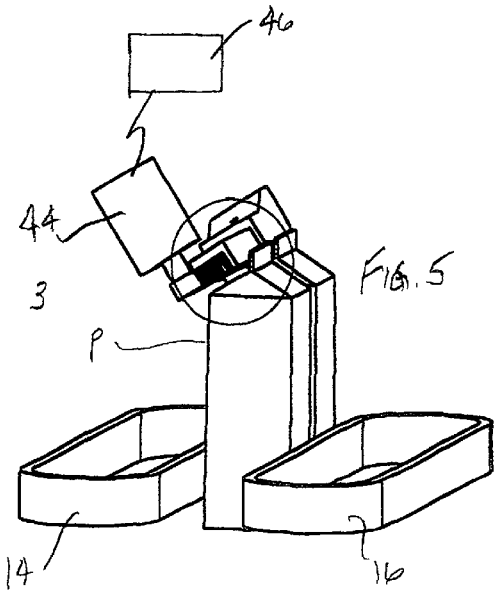
FIG. 5 is a perspective illustration showing the torque-applying assembly in contact with a cap.

Referring to FIGS. 3–4, the applicator 10 further includes a cap supply, indicated generally at 18. In the illustrated embodiment, the supply 18 includes a chute portion 20 through which the caps C traverse. As best seen in FIG. 4, the chute 20 is positioned so that an edge $C_e$ of the cap C drops below an edge 22 of the chute 20. Thus, as a carton P passes beneath the chute 20, an edge $S_e$ of the closure spout S "catches" the edge $C_e$ of the cap C. In this manner, the cap C is pulled from the chute 20 by the carton P conveyed along the conveyor 12.

In a present embodiment, a minimum retention pressure is applied to each cap C at the chute exit 30. Presently, this means for maintaining engagement of the cap C with the spout S (e.g., this pressure) is applied by a retention assembly 24. The retention assembly 24 includes a biased element 26 that exerts a downward pressure onto the cap C at the chute exit 30. In the illustrated embodiment, the element 26 is a ball or like element positioned in an opening 28 for reciprocating movement. The ball 26 is biased by a spring 32. In this manner, as a cap C is positioned at the chute exit 30, the biased element 26 prevents the cap C from "jumping" up as it is engaged by the edge $S_e$ of the passing spout S. This slight downward pressure on to the cap C assures that the spout S positively engages and "pulls" the cap C as the carton P moves passed the chute exit 30. Essentially, the ball 26 stops the cap C at the correct position at the chute exit 30 and holds back subsequent or upstream cap C, thus singulating the caps C.

As seen in FIGS. 2 and 5–7B, the carton P, having the cap C applied thereto, then moves into a torque-applying (torquing) station, indicated generally at 34. At the torquing station 34, the cap C is engaged on one side $C_{s2}$ to limit or prevent lateral movement (i.e., movement transverse to the direction of conveyance, as indicated generally at 36), and on another side $C_{s1}$ by a torque-applying (torquing) element 38. In the illustrated embodiment, a surface 40 is provided opposite the torquing element 38 to prevent lateral movement.

Figure 6:
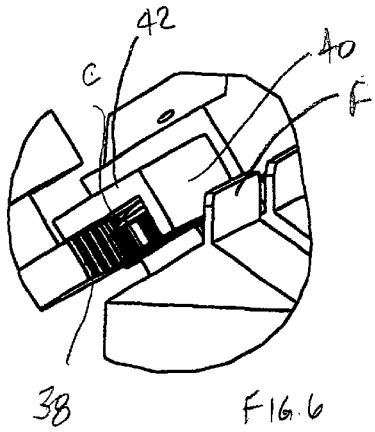
FIG. 6 is an enlarged view of the circled portion of FIG. 5.

In addition, the torquing station 34 includes an upper pressure plate 42, as seen in FIGS. 3 and 6, that is configured to engage the top T of the cap C applied on the carton P. In this manner, as the cap C is torqued (e.g., rotated) onto the spout S (as will be described below) the cap C is maintained in contact with the spout S, and thus the cap C threads are maintained engaged with the spout S threads.

In a present embodiment, the torquing element 38 is configured as a rotating belt. The belt 38 is positioned so as to engage a side $C_{s1}$ of the cap C opposite of the gable carton fin F. Because the cap C is rotated clockwise to tighten, the belt 38 rotates in a counter-clockwise direction (see FIG. 7A). Thus, the belt 38 rotates in a direction opposite of its corresponding conveying belt 12. Nevertheless, because the carton P is moving, the capping belt 38 effects a tightening of the cap C. As will be appreciated, the lateral movement preventing surface 40 is positioned between the cap C and the carton fin F.

The capping belt 38 is driven by a motor 44. In a present embodiment, the motor 44 is configured to sense the torque change on the belt 38 (as a change in voltage). Those skilled in the art will appreciate that as the cap C "tightens" onto the spout S, the force (as a rotational force or torque) required to continue tightening will increase. This increased torque is "sensed" by the motor as an increase in the voltage or current required to continue operation (i.e., turning ) of the motor 44. Thus, the motor 44 can be used to sense or monitor the torque on the cap C as an adjunct of the power requirement of the motor 44 or an adjunct of the torque required to continue tightening the cap C.

Once a desired torque on the cap C is achieved, the motor 44 changes direction and speed to match the line or carton P conveyance speed (the speed of the conveyor 12). That is, the capping belt 38 reverses direction, matches the "line speed" to assist in moving the carton P out of the conveyor 12 and, assures that the cap C remains tightened on the spout S.

Figure 7A:
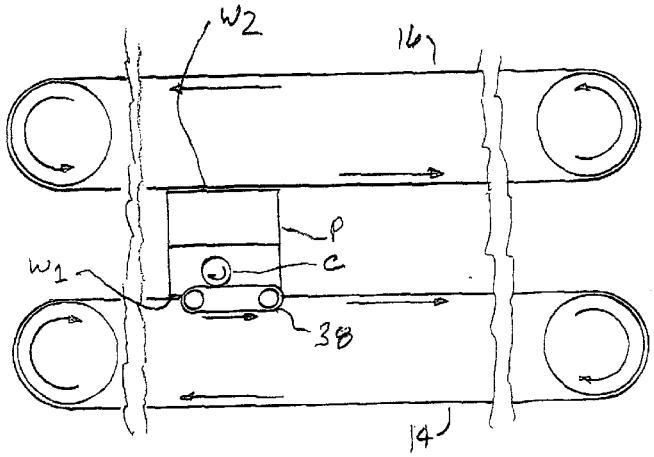
FIGS. 7A and 7B are schematic illustrations of one embodiment of the applicator showing the torque-applying element in the torquing mode in FIG. 7A and in the conveying mode in FIG. 7B.
Figure 7B:
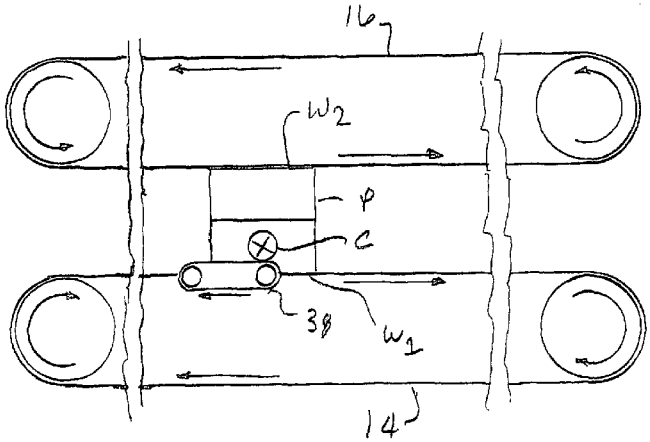

As shown schematically in FIGS. 7A and 7B, the capping belt 38 tightens the cap C on to the spout S (by moving in a counter-clockwise direction to rotate the cap C in a clockwise direction, as seen in FIG. 7A), and once a desired torque on the cap C is achieved, the capping belt 38 reverses direction and matches line speed to maintain the tightness on the cap C (as illustrated in FIG. 7B). In this manner, the cap C is maintained at a desired torque on the spout S without loosening or tightening, subsequent to the capping operation.

Figure 8A:
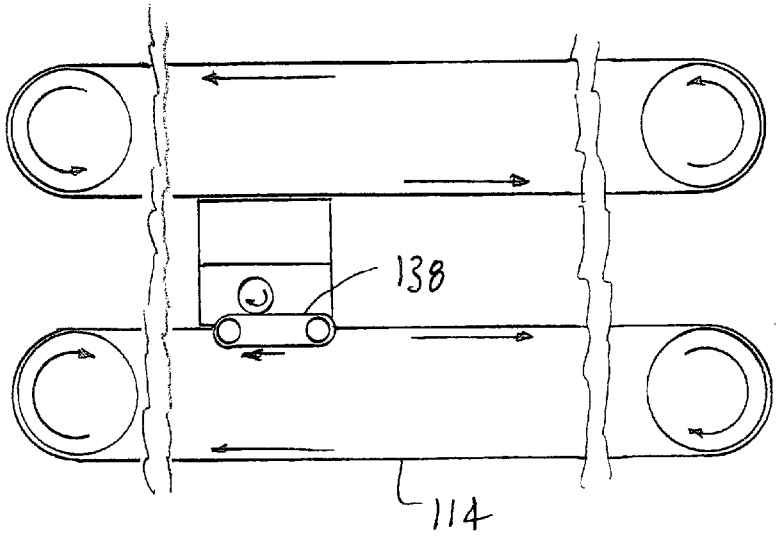
FIGS. 8A and 8B are schematic illustrations of an alternate embodiment of the applicator showing the torque-applying element in the torquing mode in FIG. 8A and in the conveying mode in FIG. 8B.
Figure 8B:
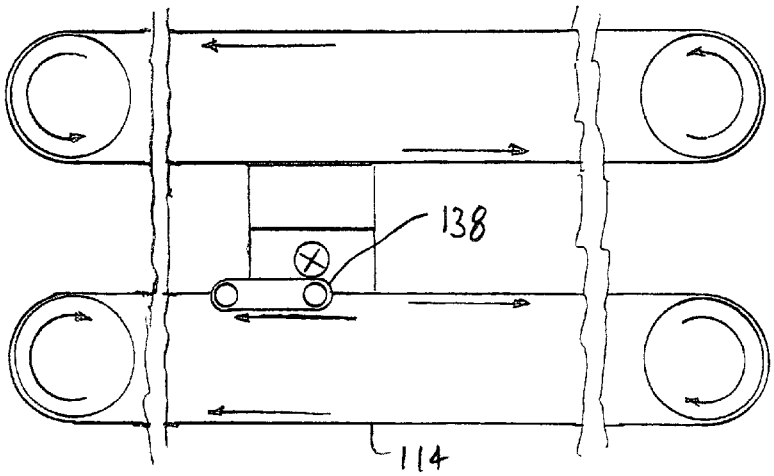

Referring now to FIGS. 8A and 8B, there is shown an alternate embodiment, or operating scheme in which the belt 138 rotates in the same direction as the conveying belt 112. However, during the capping phase or period, the belt 138 moves at a lesser rotational speed than the conveying belt, thus effecting tightening of the cap C. Upon reaching the predetermined torque, the speed of the capping belt 138 increase to match the line speed (e.g., a speed corresponding to the conveying belt 112 speed), to maintain tightness of the caps. The relative speeds of the capping and conveying belts are illustrated by the arrows at 150 and 152, respectively.

It is anticipated that various alternative structural elements and materials may be used in the present applicator. For example, the lateral movement limiting surface 40 (that surface opposite of the torquing element 38) can be a stationary surface having a smooth finish to permit rotation of the caps. Alternately, the lateral movement limiting surface 40 can be a frictional surface or it can include formations such as crenellations (e.g., teeth) to, for example, accommodate a cap having a toothed-like finish. Alternately still, the surface 40 may be a relatively soft or resilient material (moving or stationary) to permit the application of "odd-shaped" caps. For example, it is anticipated that caps having shapes such as stars, diamonds, hearts, leafs and the like, may be applied using the present applicator.

To provide precise control over the torque of the cap C onto the spout S, it is anticipated that a servo-motor 44 will be used to drive the torquing element. Such motors 44 can be precisely controlled vis-à-vis speed, direction and angular rotation so that the torquing element 38 is moved at a desired, predetermined speed.

In addition, as set forth above, such motors 44 can be used to sense the torque applied to the cap C by a change in the power required by the motor 44 to operate. To this end the motor 44 is used to sense the torque applied to the cap C and can thus be used to change "mode" from a torquing mode (FIG. 7A) to a conveyance mode (FIG. 7B) in which the torquing element 38 reverses and moves at line speed to assist in moving the carton C through the conveyor 12. A controller 46 is operably connected to the motor 44 to facilitate control of the direction and speed of the motor 44 and belt 38.

It will also be readily appreciated by those skilled in the art that although the present applicator 10 is described with reference to clockwise and counter-clockwise movement of the belts 14, 16 and 38 and the cap C, that the relative location of the capping belt 38 can be can changed or moved from above the first belt 14 to, for example, between the cap C and the carton fin F. All such variations are within the scope and spirit of the present invention.

The pressure plate 42 that is present at the chute exit 30 is configured to apply a slight pressure downward to the cap C as it is positioned on the spout S. To this end, the plate 42 can have a slight downward angle, indicated at $\alpha$, to assist in applying the downward force or urging of the cap C onto the spout S. This enhances placement of the cap C on the spout S and further facilitates properly positioning the cap C on the spout S as it passes the torquing element 38.

As will be recognized by those skilled in the art, the present applicator 10 is described relative to applying threaded caps C to threaded spouts S (i.e., rotating caps C relative and on to spouts S). As, however, will also be recognized by those skilled in the art, aspects of the present applicator 10 can also be incorporated into the application of non-threaded, custom caps, such as lugged caps, snap caps, press-fit caps and the like, to closures. For example, the minimum retention pressure assembly 24 at the chute exit 30 can be used to apply a force to facilitate positive engagement of caps to spouts as the cartons pass the chute exit 30. Likewise, the pressure plate 42, and optionally the downward angle a of the plate 42, that applies a downward pressure onto the cap to assure engagement with the spout, can also be incorporated into a non-threaded closure cap applicator.

In the present disclosure, the words "a" or "an" are to be taken to include both the singular and the plural. Conversely, any reference to plural items shall, where appropriate, include the singular.

The disclosure of each patent cited herein, whether or not done so specifically, is incorporated herein by reference.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A post processing cap applicator for applying a cap to a closure spout after erection, spout attachment, filling and sealing of a carton, comprising:

a conveyor for moving the cartons through the applicator, the conveyor moving in a first forward direction and at a predetermined rate of movement;

a cap supply configured to dispense caps and to position an edge of a cap in a path defined by movement of the closure spout through the applicator, wherein the closure spout engages the edge of the cap;

a rotating, reversible torque-applying element; and means for driving the torque-applying element in a first direction to tighten the cap onto the spout to a predetermined torque and, once the predetermined torque is reached, to reverse direction and drive the torque-applying member at a speed that is about the same as the rate of movement of the cartons through the conveyor.

2. The post processing cap applicator in accordance with claim 1 wherein the drive means is a servomotor.

3. The post processing cap applicator in accordance with claim 1 wherein the cap supply includes a chute for delivering caps to respective cartons, the chute being disposed to position the cap edge in the closure spout path.

4. The post processing cap applicator in accordance with claim 3 including a retention member disposed at about an end of the chute to retain the cap at the end of the chute for engagement by the spout.

5. The post processing cap applicator in accordance with claim 4 wherein the retention assembly includes a biased retention element.

6. The post processing cap applicator in accordance with claim 1 including a pressure plate cooperating with the torque-applying element to urge the cap onto the spout.

7. The post processing cap applicator in accordance with claim 1 wherein the torque-applying element is a reversibly rotating belt.

8. The post processing cap applicator in accordance with claim 1 including a lateral movement inhibiting member disposed on a side of the cap opposite the torque-applying element.

9. The post processing cap applicator in accordance wit claim 8 wherein the lateral movement inhibiting member is a surface.

10. The post processing cap applicator in accordance with claim 9 wherein the surface is smooth.

11. The post processing cap applicator in accordance with claim 6 including a lateral movement inhibiting member disposed on a side of the cap opposite the torque-applying element, wherein the lateral movement inhibiting surface is coextensive with the pressure plate.

12. The post processing cap applicator in accordance with claim 1 wherein the conveyor is formed as a first and second rotating conveying belts for engaging first and second sides of the carton, respectively, and wherein the torque-applying element is a reversibly rotating capping belt disposed on the first side of the carton above the first conveying belt, the capping belt configured to rotate in a direction opposite of the first conveying belt when tightening the cap onto the spout and configured to reverse direction upon reaching the predetermined torque.

13. A post processing cap applicator for applying a cap to a closure spout after erection, spout attachment, filling and sealing of a carton, comprising:

a conveyor for moving the cartons through the applicator, the conveyor moving in a first forward conveyor direction and at a predetermined rate of movement;

a cap supply configured to dispense caps and to position an edge of a cap in a path defined by movement of the closure spout through the applicator, wherein the closure spout engages the edge of the cap;

a rotating, torque-applying element; and means for driving the torque-applying element in a first direction at a first speed to tighten the cap onto the spout to a predetermined torque and, once the predetermined torque is reached, to drive the torque-applying member in a second direction and at a second speed that is about the same as the rate of movement of the cartons through the conveyor.

14. The post processing cap applicator in accordance with claim 13 wherein the torque-applying first direction is the same as the first forward conveyor direction and the torque-applying first speed is less than the rate of movement of cartons through the conveyor and wherein the second direction is the same as the torque-applying first direction and the second speed is about he same as the rate of movement of cartons through the conveyor.

15. The post processing cap applicator in accordance with claim 13 wherein the torque-applying first direction is opposite the first forward conveyor direction and wherein the second direction is opposite the torque-applying first direction.

16. The post processing cap applicator in accordance with claim 13 wherein the conveyor is formed as a first and second rotating conveying belts for engaging first and second sides of the carton, respectively, and wherein the torque-applying element is a rotating capping belt.

* * * * *